United States Patent [19]

Laridon et al.

[11] 3,980,480

[45] Sept. 14, 1976

[54] PHOTOGRAPHIC RECORDING AND REPRODUCTION OF INFORMATION PHOTOCHROMIC COMPOSITION CONTAINING POLYHALOGENATED HYDROCARBON, SPIROPYRAN COMPOUND AND HETEROCYCLIC MERCAPTO COMPOUND AND THE USE THEREOF

[76] Inventors: Urbain Leopold Laridon, Damhertenlaan 36, B 2610 Wilrijk; Jozef Willy Van den Houte, Oostvaartdijk 46, B 1850 Grimbergen, both of Belgium

[22] Filed: July 18, 1975

[21] Appl. No.: 597,231

Related U.S. Application Data

[63] Continuation of Ser. No. 411,787, Nov. 1, 1973, abandoned, which is a continuation of Ser. No. 177,121, Sept. 1, 1971, abandoned.

[30] Foreign Application Priority Data

Sept. 1, 1970 United Kingdom ..... 41749/70

[52] U.S. Cl. ..... 96/48 R; 96/48 QP; 96/119 PQ; 96/47; 96/45.2; 250/323; 96/90 PC; 96/90 R

[51] Int. Cl.[2] ..... G03C 5/24; G03C 1/52

[58] Field of Search ..... 96/48 R, 48 QP, 48 HD, 96/90 R, 90 PC, 119 QP, 47, 45.2; 250/323

[56] References Cited

UNITED STATES PATENTS

| | | | |
|---|---|---|---|
| 3,147,117 | 9/1964 | Wainer et al. | 96/48 R |
| 3,322,542 | 5/1967 | Ullman et al. | 96/90 PC |
| 3,359,105 | 12/1967 | Wainer | 96/90 R |
| 3,436,353 | 4/1969 | Dreyer et al. | 96/90 PC |
| 3,486,899 | 12/1969 | Brown | 96/90 PC |
| 3,510,300 | 5/1970 | Fotland et al. | 96/90 R |
| 3,558,317 | 1/1971 | Petro et al. | 96/90 R |
| 3,642,479 | 2/1972 | Van Allan et al. | 96/90 PC |
| 3,660,086 | 5/1972 | Tamai et al. | 96/90 PC |
| 3,667,949 | 6/1972 | Inoue et al. | 96/48 R |

FOREIGN PATENTS OR APPLICATIONS

| | | | |
|---|---|---|---|
| 1,274,655 | 8/1968 | Germany | 96/90 PC |

*Primary Examiner*—Won H. Louie, Jr.
*Attorney, Agent, or Firm*—William J. Daniel

[57] ABSTRACT

A photographic process wherein a visible image is formed by print-out or optical development in a recording material comprising in intimate admixture a spiropyran compound, an ultra-violet light-sensitive compound capable of producing an exposure with ultra-violet light with the spiropyran a dye salt and as sensitizing agent an organic nitrogen containing compound having a thiol group or in its tautomeric form a thione group as represented in the following tautomeric structural parts :

Preferred recording materials contain a spirodinaphthopyran compound, carbon tetrabromide and/or iodoform and as sensitizing agent 2-mercaptobenzthiazole in conjunction with a triaryl stibine as antifogging agent.

23 Claims, No Drawings

PHOTOGRAPHIC RECORDING AND REPRODUCTION OF INFORMATION PHOTOCHROMIC COMPOSITION CONTAINING POLYHALOGENATED HYDROCARBON, SPIROPYRAN COMPOUND AND HETEROCYCLIC MERCAPTO COMPOUND AND THE USE THEREOF

This is a continuation of Ser. No. 411,787, filed Nov. 1, 1973, which is a continuation of Ser. No. 177,121 filed Sept. 1, 1971 now abandoned.

This invention relates to photographic recording and reproduction of information and to materials suited therefor.

The use of particular spiropyrans in the manufacture of photographic recording materials is known e.g. from the U.S. Pat. No. 2,953,454 of E. Berman — Nat. Cash Reg., issued Sept. 20, 1960. The spiropyrans described therein are characterized as being reversibly transformable into a coloured form by activating electromagnetic energy.

In many applications such reversible transformation is not desirable and therefore efforts have been made to obtain a print-out colour image the colour of which does not fade by keeping it in the dark or by a further irradiation with electromagnetic radiation differing in wavelength from the radiation originally applied.

In the German Pat. No. 1,274,655 a recording material has been described by means of which stable print-out dyestuff images can be obtained by using spiropyrans in admixture with a compound that activated with electromagnetic radiation can yield photolytically formed free radicals.

The starting substances for these radicals are preferably halogenated organic compounds.

The recording materials described in the latter Patent Specification need rather long exposure times with the conventional ultra-violet light sources.

It is an object of the present invention to provide a method for increasing the photosensitivity of recording materials which contain a photosensitive compound that by information-wise exposure to activating electromagnetic radiation yields a dyestuff image by reaction with a spiropyran compound.

It is another object of the present invention to provide a method for making visible or intensifying a latent image or barely visible image produced with said spiropyran and photosensitive compound. Said method is called hereinafter "optical development" for it operates with an overall exposure in the wavelength range of electromagnetic radiation absorbed by dyestuff traces formed in the image-wise exposure.

It is a further object of the present invention to provide photographic materials suited for use in said methods.

It has now been found that the photosensitivity for forming a directly visible image or optical development sensitivity of a recording material containing in intimate admixture:

1. at least one spiropyran compound, and
2. at least one ultra-violet light-sensitive compound capable of producing on exposure with ultraviolet light with said spiropyran compound a dyestuff salt is increased by applying in working relationship with said mixture an organic nitrogen containing compound having a thiol group or in its tautomeric form a thione group as represented in the following tautomeric structural parts:

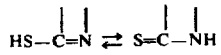

Preferred organic nitrogen containing compounds are within the scope of the following tautomeric general formulae:

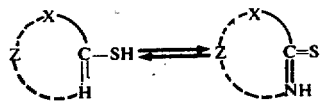

wherein:

X represents oxygen, sulphur, selenium or the group

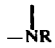

in which R is hydrogen or an organic group e.g. an alkyl group including a substituted alkyl group, preferably a $C_1$–$C_5$-alkyl group, and Z represents the necessary atoms to close a 5- or 6-membered heterocyclic nitrogen containing ring or ring system including such ring or ring system in substituted form e.g. a benzthiazole, benzselenazole, benzoxazole, or benzimidazole ring.

Particular examples of useful sensitizing agents are:

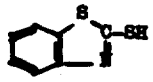

1.

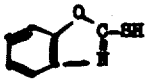

2.

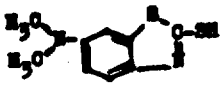

3.

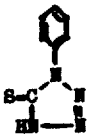

4.

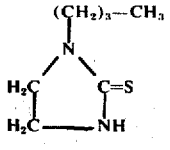

5.

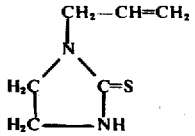

6.

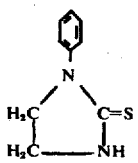

7.

imidazolidine-4-on-2-thiones, e.g.:

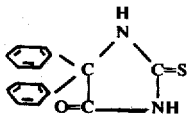

8.

tetrahydro pyrimidine-2-thiones, e.g.:

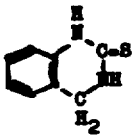

9.

tetrahydro- and dihydro-oxazine-2-thiones and thiazine-2-thiones, e.g.:

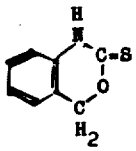

10.

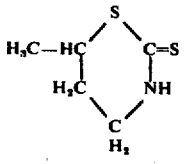

11.

1,3,4-dihydro thiadiazine-2-thiones, e.g.:

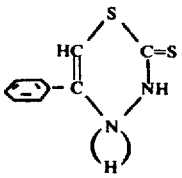

12.

thiourea compounds including substituted derivatives preferably N-phenyl thiourea compounds, e.g.:

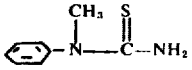

13.

thioamides, e.g.:

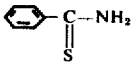

14.

It is remarkable that most of the suitable sensitizing mercapto compounds are generally known black-toning agents in the silver complex diffusion transfer process.

Spiropyran compounds suited for photographic image formation according to the present invention are spiropyrans containing at least one pyran ring having in the ortho- and meta-position to the oxygen atom a condensed benzo, naphtho or other higher aromatic polycyclic condensed ring system including these condensed rings or ring systems in substituted state e.g. an anthraceno or a phenanthreno ring system e.g. as present in a spirodibenzopyran, a spirodinaphthopyran, a spirobenzonaphthopyran, a 1,3,3-trimethylindolinobenzospiropyran, a 1,3,3-trimethylindolinonaphthospiropyran or such spiropyrans containing condensed aromatic nuclei of the anthracene or phenanthrene type.

In said spiropyrans the pyran rings, the condensed benzo, the condensed higher aromatic rings as well as the 1,3,3-trimethylindolino ring may be substituted.

Suitable substituents therefore are e.g. hydrocarbon groups such as alkyl groups, e.g. lower alkyl groups such as methyl, substituted alkyl groups e.g. halogen, or phenyl substituted alkyl groups, alkylene ester groups e.g. a $-CH_2-COOC_2H_5$ group, alkylene carboxyl groups e.g. a $-CH_2-COOH$ group, carbonamide groups or substituted carbonamide groups e.g. a

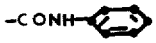

group, halogen, nitro, hydroxy, alkoxy, aryloxy or a substituent linking the carbon atoms in 3,3'-position in the spiropyran system together e.g. a $(CH_2)_n$-chain wherein $n$ is 2 or 3.

General formulae covering particularly suited spiropyrans are the following:

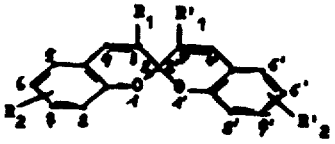

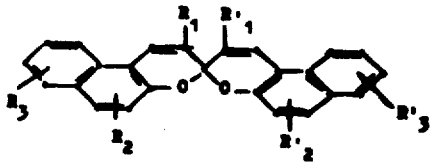

-continued

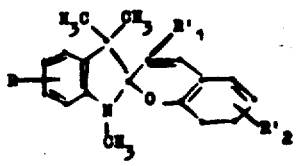

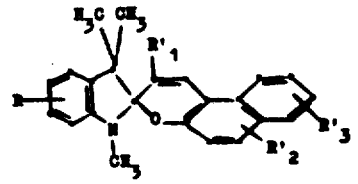

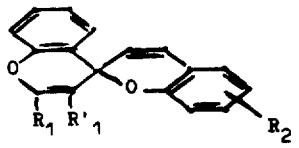

herein:

R, $R_1$, $R'_1$, $R_2$, $R'_2$, $R_3$ and $R'_3$ represent hydrogen, an aliphatic group including a substituted aliphatic group e.g. a ($C_1$–$C_{20}$)alkyl group including such an alkyl group in substituted form, more particularly a methyl, ethyl, propyl, amyl or hexadecyl group or halogen substituted alkyl group, halogen, nitro, hydroxy, an alkoxy or aryloxy group, a phenyl group or a substituted phenyl group, piperidyl, an alkylene ester group e.g. a $—CH_2—COOC_2H_5$ group, an alkylene carboxyl group e.g. a $—CH_2—COOH$ group, a carbonamide group or a substituted carbonamide group e.g. a

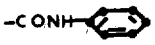

group, or $R_1$ and $R'_1$ together represent a $—(CH_2)_n—$ chain wherein $n = 2$, or 3 to link the carbon atoms in the 3 and 3′ positions together.

Suited spiropyran compounds and their preparation are described in the published German Patent Applications Nos. 1,274,655 filed Dec. 15, 1965 by Telefunken Patentverwertungs G.m.b.H., 1,269,665, 1,286,110, 1,286,111 and 1,286,112 all filed Sept. 30, 1966 by Telefunken Patentverwertungs G.m.b.H., and by W. Dilthey, Berres, Holterkoff, Wubken, J.Pr.Ch. [2] 114, 187 (1926), *by C. F. Koelsch and W. R. Workman in J.A.C.S.* 74, 6288 (1952) and in J.Chem.Soc. (1934), 1571 by I. M. Heilbron and G. F. Howard.

Preferred spiropyran compounds are spirodinaphthopyrans and spirobenzonaphthopyrans including such compounds wherein the naphtho- and/or benzo ring(s) is (are) substituted.

An illustrative list of particularly useful spiropyran compounds is given in the following Table 1.

Table 1

| | Spiropyran compound | Melting point (°C) |
|---|---|---|
| 1. | 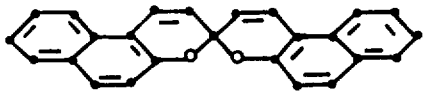 | 257 |
| 2. | 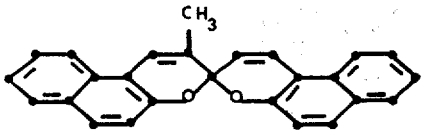 | 204 |
| 3. | 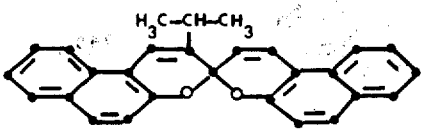 | 208 |
| 4. | 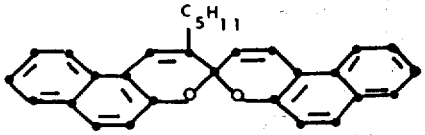 | 185 |
| 5. | 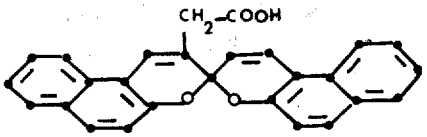 | 164 |

Table I – Continued
| Spiropyran compound | Melting point (°C) |
|---|---|
| 6. 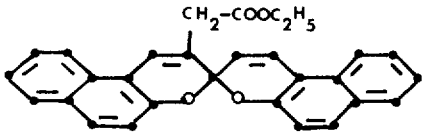 | 166 |
| 7. 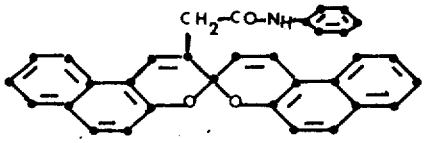 | 210 |
| 8. 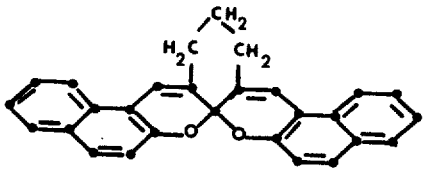 | 238 |
| 9. 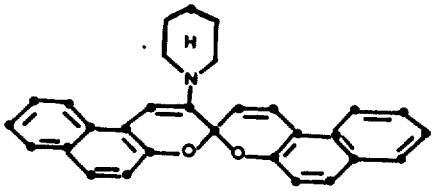 | 140 |
| 10. 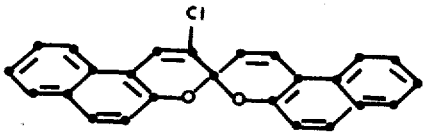 | 180 |
| 11. 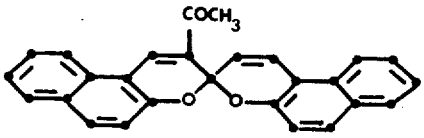 | 260 |
| 12. 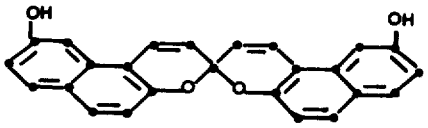 | > 260 |
| 13. 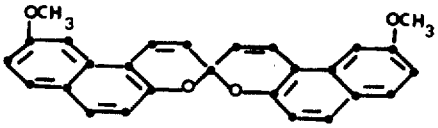 | > 260 |
| 14. 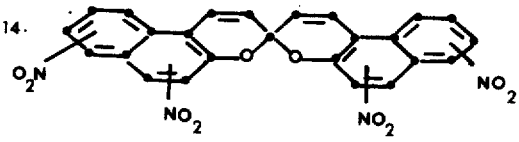 | > 260 |

Table I – Continued
| Spiropyran compound | Melting point (°C) |
|---|---|
| 15. 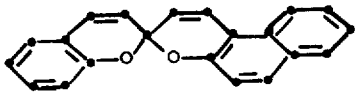 | 168 |
| 16. 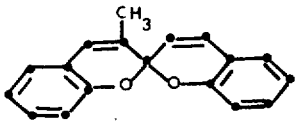 | 110 |
| 17. 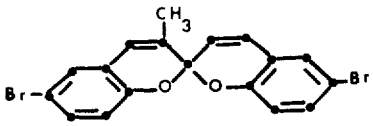 | 163 |
| 18. 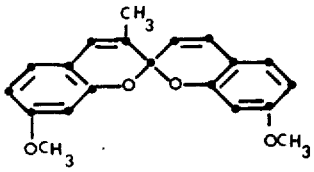 | 110 |
| 19. 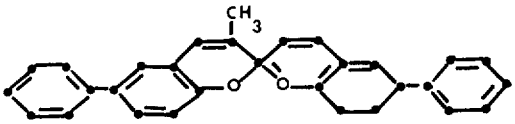 | 185 |
| 20. 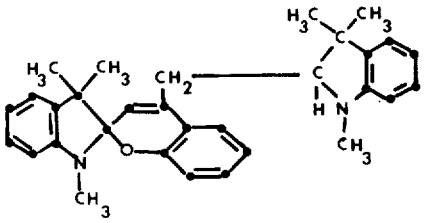 | 206 |
| 21. 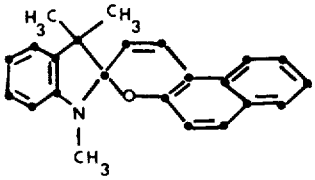 | 180 |
| 22. 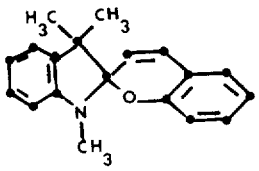 | 88 |

Table I – Continued
| Spiropyran compound | Melting point (°C) |
|---|---|
| 23. 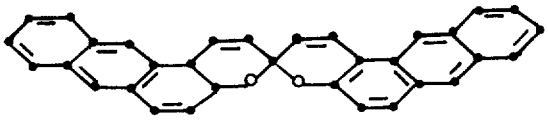 | > 260 |
| 24. 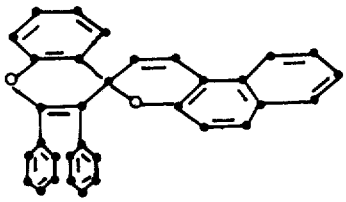 | 173 |
| 25. 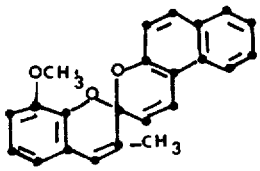  | 193 |
| 26. 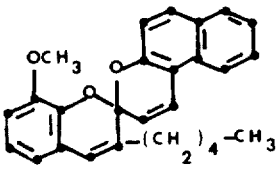  | 158 |
| 27. 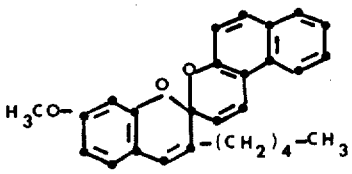  | 144 |
| 28. 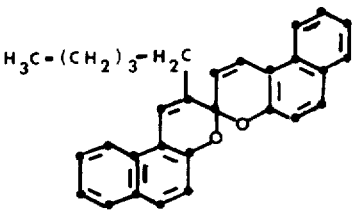  | 180 |
| 29. 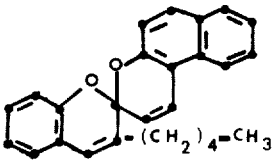  | 160 |

Table 1 – Continued
| | Spiropyran compound | Melting point (°C) |
|---|---|---|
| 30. | 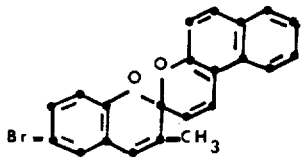 | 112 |
| 31. | 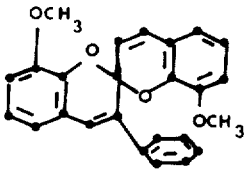 | 120 |
| 32. | 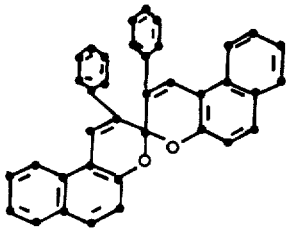 | ± 200 |
| 33. | 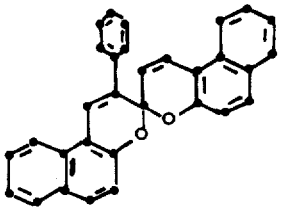 | 248 |
| 34. | 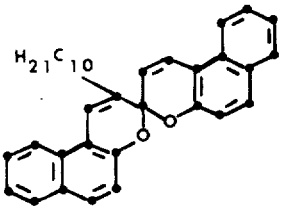 | 152 |
| 35. | 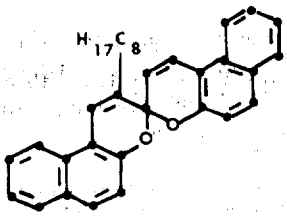 | 160 |

Table 1 – Continued

| Spiropyran compound | Melting point (°C) |
|---|---|
| 36. 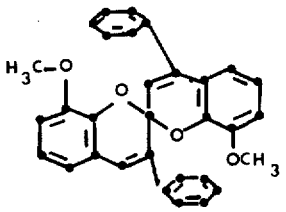 | ± 250 |
| 37. 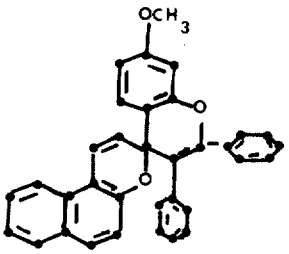 | 173 |
| 38. 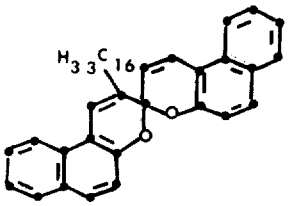 | 133 |
| 39. 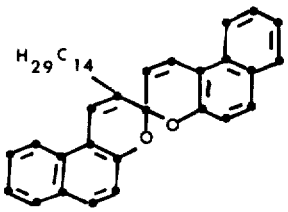 | 146 |

In order to illustrate in more details the preparation of the diarylo spiro-pyran compounds and the indolino-arylospiropyran compounds the following preparation receipts are given:

PREPARATION 1

Preparation of 3-methyldi-β-naphthospiropyran (Compound 2 of Table 2)

In a 2 liter three-necked flask, fitted with a reflux condenser and a gas inlet tube reaching nearly the bottom of the flask are introduced:

| | |
|---|---|
| ethanol | 1 liter |
| butanone | 22 ml (0.25 mole) |
| 2-hydroxy-1-naphthaldehyde | 86 g (0.5 mole) |

The flask is shaked until partial dissolution of the ingredients. Dry hydrogen chloride gas is introduced at a rate which allows complete absorption and the start of ethanol reflux. Thereupon the already strongly blue coloured mixture is cooled down in a mixture of ice and sodium chloride and the introduction of hydrogen chloride gas continued until saturation. In the reaction mixture green crystals of pyrylium salt are formed and the crystallization allowed to proceed overnight in a refrigerator.

The formed pyrylium salt is separated by suction, is washed with ethanol and thereupon brought into suspension in 300 ml of ethanol.

Whilst stirring a 10 % by weight aqueous solution of ammonium hydroxide is added until the mixture is definitely alcaline. During that operation the mixture becomes colourless.

The obtained crystalline product is separated by suction, washed with water and dried.

Finally the spiropyran compound is recrystallized from 600 ml of benzene and again separated and dried under reduced pressure at 50°–60°C. Yield: 45 g. Melting point: 204°C.

PREPARATION 2

Preparation of 1,3,3-trimethylindolinobenzopyrylospiran (Compound 22 of Table 2)

In a 100 ml flask fitted with a reflux condenser are introduced the following ingredients:

| | |
|---|---|
| salicylaldehyde | 3.7 g (0.03 mole) |
| 1,3,3-trimethyl-2-methylene indolamine | 5.1 g (0.03 mole) |
| ethanol | 90 ml |

The solution is boiled under reflux for a period of 2 hours. Thereupon the mixture is cooled down and filtered.

To the filtrate water is added for separation of a solid product. The solid is separated by suction, washed with water and dried under vacuum conditions.

The spiran compound is recrystallized from 15 ml of hexane.

Yield: 5 g. Melting point: 93°–94°C.

The compound capable of producing a dye salt with a spiropyran on exposure to activating electromagnetic radiation is for use according to the present invention preferably an organic polyhalogen compound of which a halogen containing radical can be photolytically separated. Compounds possessing that property are within the scope of the following general formula:

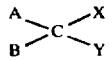

wherein:

each of A, B, X and Y are halogen atoms of the group of chlorine, bromine or iodine, or wherein one of said radicals A, B, X or Y represents an alkyl group, including a substituted alkyl group e.g. a halogen substituted alkyl radical, a hydroxyalkyl radical or an aralkyl radical e.g. a benzyl radical, an aryl group, a substituted aryl group or an aroyl group and the other radicals chlorine, bromine or iodine, or wherein at least two of said radicals A, B, X or Y represent an aromatic acyl group e.g. a benzoyl group and the other radicals chlorine, bromine or iodine.

Suitable representatives falling within the scope of that general formula are organic halides such as carbon tetrabromide, bromoform, iodoform, hexachloroethane, hexahexabromoethane, pentabromoethane, 1,1,2,2-tetrabromoethane, α,α,α-tribromoacetophenone and tribromoethanol.

The amount of sensitizing agent is not critical.

A rather small amount of sensitizing agent with respect to the spiropyran compound may be used (see the Examples).

The spiropyran compound(s) are preferably used in admixture with a 5- to 20-fold amount by weight of photosensitive organic halogen compound such as carbon tetrabromide. This ratio is, however, not limitative since useful results can be obtained with e.g. the spiropyran and photosensitive polyhalogen compound in a ratio by weight in the range of 1:1 to 1:50.

A sensitizing agent of the above general formulae may be used alone or in combination with one or more other sensitizing compounds belonging to one of the following classes:

A. organic compounds containing two radicals of different electron-affinity (the term radical includes group as well as atom) linked to each other through a conjugated system, Useful sensitizing agents of class (A) are those having one of the following general formulae (I), (II), (III), (IV), (V) or (VI):

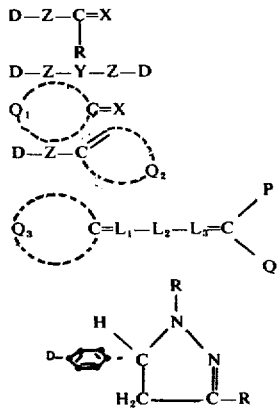

(I)

(II)

(III)

(IV)

(V)

(VI)

wherein:

D represents an electron-donating group e.g. an alkyl (preferably $C_1$–$C_5$ alkyl), cycloalkyl or aralkyl substituted amino or hydroxy group, preferably a monoalkyl amino group, a dialkylamino group or an alkoxy group, Z represents a conjugated system e.g. a polymethine chain or an azamethine chain including such chain that is substituted or makes part of a ring structure e.g. a phenylene or a naphthylene ring, R represents hydrogen, a hydrocarbon radical e.g. an alkyl, an aryl or a heterocyclic group preferably a methyl group or a phenyl group, or the necessary atoms to form a homocyclic or heterocyclic ring with an atom of the group Z, $Q_1$ represents the non-metallic atoms necessary to complete a ring or ring system in which the group C=X through a conjugated system is linked to an electrondonating group as described for D, X represents an electronegative atom or group e.g. oxygen, =N—R wherein R is hydrogen or an aromatic group, sulphur, selenium

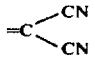

and other bivalent electron-attracting groups known in organic chemistry, preferably however X represents oxygen or sulphur, $Q_2$ represents the non-metallic atoms necessary to complete a ring or ring system wherein the group

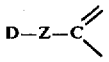

is linked through a conjugated system to an electron-attracting group e.g. a carbonyl group, a thiocarbonyl group, a sulfonyl group or a dicyanomethylene group, or represents the necessary atoms to form with the carbon atom of the group

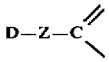

a heterocyclic ring having an electronegative character with respect to the group D e.g. a benzoxazole ring, Y represents an electron-attracting group e.g.

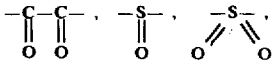

or the group

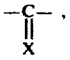

wherein Y has the same meaning as described above, $Q_3$ represents a heterocyclic nucleus, containing an electrondonating group e.g. a dialkylamino group that is linked through a conjugated system with the group

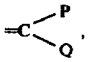

wherein P and Q each represent an electron-attracting substituent e.g. a cyano group or wherein P and Q together represent the necessary atoms to close a heterocyclic ring with electronegative character e.g. as present in merocyanine dyes such as a ketomethylene ring of which a rhodanine nucleus is a particular example, each of $L_1$ and $L_3$ represent a methine group or a substituted methine group, and $L_2$ represents a monovalent chemical bond, an $\alpha,\beta$-ethylenically unsaturated bivalent group e.g. a

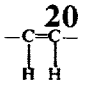

group or a plurality of said groups linked to each other, or $L_1$, $L_2$ and $L_3$ represent together a double bond linking the group

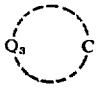

to the group

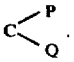

Preferred compounds falling within the scope of formula (I) are:

1. 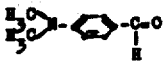

2. 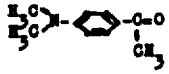

Preferred compounds falling within the scope of formula (II) are:

3. 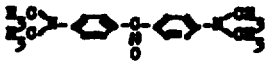

4. 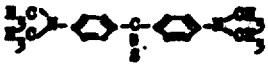

5. 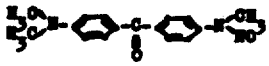

6. 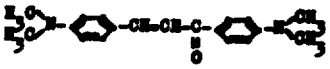

7. 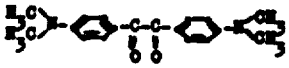

Preferred compounds falling within the scope of formula (III) are described e.g. in the Belgian Pat. No. 747,849 filed Mar. 23, 1970 by Gevaert-Agfa N.V. corresponding with the U.S. Pat. Appl. Ser. No. 22,376. Representatives thereof are e.g.:

8.

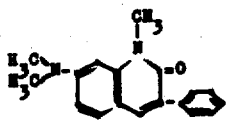

9.

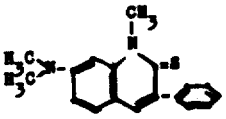

10.

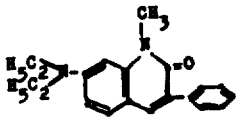

11.

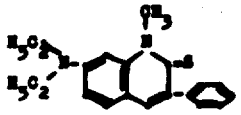

Preferred compounds falling within the scope of formula (IV) are styryl dye bases and styryl vinyl dye bases and compounds such as:

| | | |
|---|---|---|
| 12. | 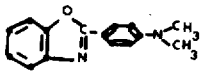 | (ref. U.S. Pat. Specification 2,793,792 of J.B. Pilkington, issued May 28, 1957) |
| 13. | 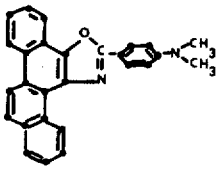 | (ref. J.Prakt.Chem.[2], 157, p. 219 (1941)) |
| 14. | 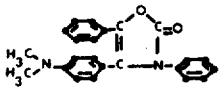 | (ref. Ber. 89, p. 1748 (1956)) |
| 15. | 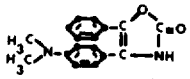 | (ref. Ber. 89, p. 1745 (1956)) |
| 16. | 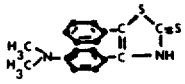 | |
| 17. | 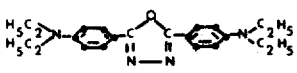 | (ref. U.S.Pat.Spec. 3,189,447 of Wilhelm Mengebauer, Martha Tomanek and Hans Behmenburg, issued June 15, 1965) |

Preferred compounds falling within the scope of formula (VI) are described in the United Kingdom Pat. Specification No. 853,880 filed Dec. 16, 1957 by Kalle AG, e.g.:

18.

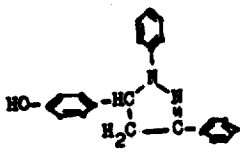

Preferred compounds falling within the scope of formula (V) are merocyanines e.g. those described in the United Kingdom Pat. Specification No. 1,131,238 filed Nov. 16, 1965 by Eastman Kodak Co. Representatives thereof are e.g.:

19.

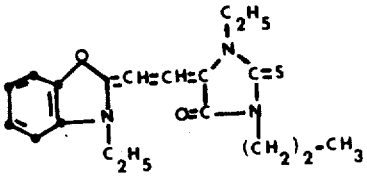

20.

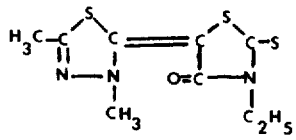

21.

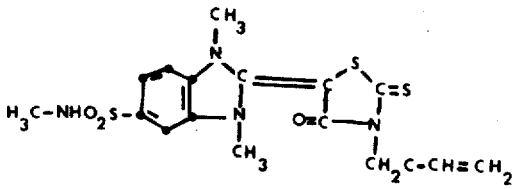

22.

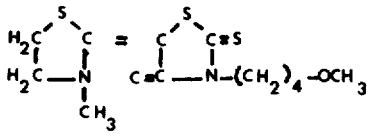

23.

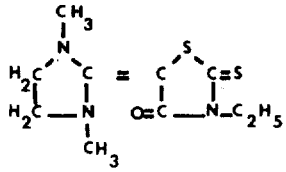

24.

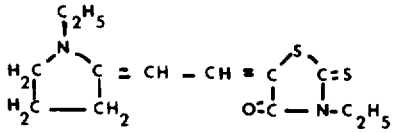

25.

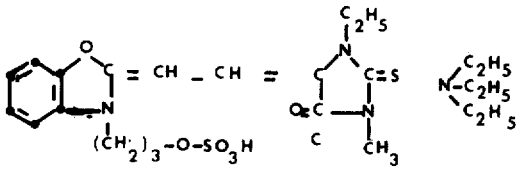

B. organic compounds containing an aromatic nucleus or aromatic ring system in which two adjacent carbon atoms are common to said nucleus or ring system and to an adjacent ring which has no conjugated character and which at one end is linked to the aromatic nucleus or ring system through a carbon-carbon bond and at the other end is linked to said nucleus or ring system through an electron-donating group such as a secondary or tertiary amino group, said organic compounds include those having a said nucleus or ring system in substituted form.

Preferred compounds belonging to class (B) are described e.g. in the Belgian Pat. No. 727,433 filed Jan. 27, 1969 by Gevaert-Agfa N.V. corresponding with the U.S. Pat. Appl. Ser. No. 793,881. Representatives thereof are e.g.:

26.

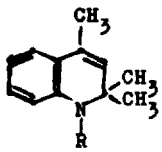

27.

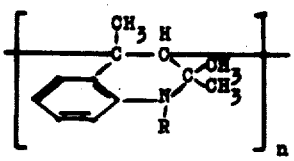

wherein:

*n* is a positive integer of at least 2, and

R represents hydrogen or an alkyl group including a substituted alkyl group.

C. Polymeric compounds containing recurring units corresponding to the following general structure:

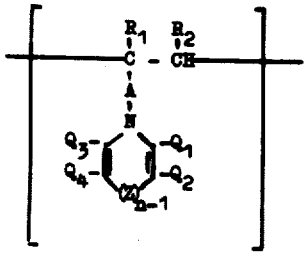

wherein:

Z represents a sulphur atom or a single bond,

A represents a single bond or a divalent hydrocarbon group e.g. a $—CH_2—$ group, $R_1$ represents hydrogen or a lower alkyl radical, e.g. a methyl radical, $R_2$ represents hydrogen or a lower alkyl radical, e.g. a methyl or an ethyl radical, $Q_1$ and $Q_2$ each represent a hydrogen atom or together the necessary atoms to close an adjacent carbocyclic ring or ring system including such ring or ring system in substituted form, preferably an aromatic ring (e.g. a benzene ring) including a substituted aromatic ring e.g. a halogen substituted (chlorine, bromine or iodine substituted) benzene ring, $Q_4$ and $Q_3$ each represent a hydrogen atom or together the necessary atoms to close an adjacent carbocyclic nucleus or ring system including such a ring or ring system in substituted form, preferably an aromatic ring (e.g. a benzene ring) including a substituted aromatic ring e.g. a halogen substituted (chlorine, bromine or iodine substituted) benzene ring, and

*n* represents 1 or 2.

The N-vinyl polymers and copolymers can be prepared by application of one of the various known polymerization procedures, e.g., by pearl- or emulsion polymerization or by polymerization in solution, whereby the initiation of the polymerization can occur by free radicals, by ion formation, or by radiation e.g., with actinic light. It is to be noted that the polymerization degree is not critical and can vary between wide limits. As far as the copolymers are concerned, it is further to be noted that the content of groups corresponding to the general formula given hereinbefore is not critical and, as shown furtheron in the table of copolymers containing N-vinylcarbazole units, can vary between wide limits, say, e.g. between 20 and 95 %, taking into account the properties of the compounds used in the preparation of the copolymers and the required sensitizing and/or mechanical properties. In general, the best results are attained with copolymers having a content of vinylcarbazole units between 40 and 90 %.

The preparation of suitable poly-N-vinylcarbazoles is described e.g. in the German Pat. Nos. 931,731 filed Mar. 4, 1953; 936,421 filed Feb. 20, 1953; 1,097,680 filed Oct. 15, 1959 all three by B.A.S.F., and 1,158,367 filed July 18, 1962 by Gevaert Photo-Producten N.V.; and the U.S. Pat. No. 2,072,465 of W. Reppe, E. Keyssner and E. Dorrer, issued Mar. 2, 1937. The preparation of poly-N-vinyl-pyrrole proceeds analogously.

The preparation of suitable N-vinylcarbazole copolymers is described in the United Kingdom Pat. Specification No. 964,875 filed Apr. 21, 1960 by Gevaert Photo-Producten N.V. which specification also contains a preparation receipt for poly(N-allyl carbazole) ($R_1 = CH_3$ and $R_2 = H$) and for poly(N-propenyl carbazole)($R_1 = H$, $R_2 = H$, $A = -CH_2-$).

The poly-N-vinyl indoles are described in the published German Patent Application Nos. 1,906,841 filed Feb. 12, 1969 and 1,917,747 filed Apr. 5, 1969 by I.B.M. Corp. The poly-N-vinyl diphenylamine is described in the published German Patent Application No. 2,007,692 filed Mar. 3, 1969 by Xerox corp. Halogen-substituted poly-N-vinyl carbazoles are described in the published Japanese Patent Applications Nos. 21,875/67 filed June 18, 1964; 25,230/67 filed Oct. 13, 1864; 7,592/68 filed Nov. 27, 1964; 19,751/67 filed June 18, 1964 and 7,591/68 filed Nov. 18, 1964 all by Matsushita Electric Industrial Co. Ltd.

For illustrative purposes suitable vinyl copolymers containing N-vinyl carbazole units are enumerated in the following table 2.

Table 2

| Copolymer | mole % of N-vinyl carbazole |
|---|---|
| copolymer of N-vinylcarbazole and vinylidene chloride | 85.4 |
| copolymer of N-vinylcarbazole and 3,3',5-trimethyl isononylether | 93 |
| copolymer of N-vinylcarbazole and vinyl acetate | 88.6 |
| copolymer of N-vinylcarbazole and isopropenyl acetate | 94.5 |
| copolymer of N-vinylcarbazole and vinylstearate | 37.5 |
| copolymer of N-vinylcarbazole and methyl-acrylate | 67.6 |
| copolymer of N-vinylcarbazole and ethyl-acrylate | 41 |
| graft copolymer of N-vinylcarbazole and ethyl-acrylate | 90.3 |
| emulsion polymer of N-vinylcarbazole and polyethylacrylate | 94.5 |
| copolymer of N-vinylcarbazole and n-butyl-acrylate | 58.3 |
| copolymer of N-vinylcarbazole and 2-ethyl-hexylacrylate | 51.6 |
| copolymer of N-vinylcarbazole and acryloxy-ethyldiethylamine | 76.6 |
| copolymer of N-vinylcarbazole and vinylcinnamate | 92.5 |
| copolymer of N-vinylcarbazole and methyl-methacrylate | 62.7 |
| copolymer of N-vinylcarbazole and isobutyl-methacrylate | 51.8 |
| copolymer of N-vinylcarbazole and lauryl-methacrylate | 77.4 |
| copolymer of N-vinylcarbazole and methylacryl-oxyethyl diethylamine | 9.7 |
| copolymer of N-vinylcarbazole and acrylonitrile | 88 |
| graft copolymer of N-vinylcarbazole and butyl-aldehyde acetal of polyvinylalcohol | 30 |
| copolymer of N-vinylcarbazole and di(2-di-chloroethyl)-vinylphosphonate | 82.4 |
| copolymer of N-vinylcarbazole and styrene | 49 |
| graft copolymer of N-vinylcarbazole and poly-styrene | 27.3 |
| copolymer of N-vinylcarbazole and vinylnaphthalene | 47.1 |
| copolymer of N-vinylcarbazole and anthracene-(9,10) | 91.5 |
| copolymer of N-vinylcarbazole and 2-vinylpyridine | 31.8 |
| copolymer of N-vinylcarbazole and 4-vinyl-pyridine | 32.4 |
| copolymer of N-vinylcarbazole and N-vinyl-pyrrolidine | 69.1 |
| terpolymer of N-vinylcarbazole, acrylonitrile and styrene | 20 |
| graft copolymer of a terpolymer of vinyl chloride, vinyl acetate and vinyl alcohol with N-vinylcarbazole | 29.4 |
| graft copolymer of a terpolymer of vinyl chloride, vinyl acetate and maleic anhydride with N-vinylcarbazole | 55.1 |

D. inorganic compounds producing photoelectrons under the influence of activating electromagnetic radiation and having a basic or amphoteric character e.g. photoconductive zinc oxide and PbO.

In case photoconductive zinc oxide is used as sensitizing substance the recording layer contains preferably from 5 to 50 parts by weight of zinc oxide dispersed in 100 parts by weight of binding agent containing the spiropyran compound(s) preferably in an amount of 1 to 50 parts by weight and the photosensitive reactant for forming the dyestuff salt e.g. a photosensitive organic halogen compound such as carbon tetrabromide and/or iodoform in an amount of 10 to 250 parts by weight.

As a further constituent the photosensitive recording layer according to the present invention may contain a filmforming binder. For that purpose preferably hydrophobic polymers are used that shield as much as possible the ingredients from a direct contact with the atmosphere and more especially from oxygen.

Particularly suitable binders for use in the present invention are hydrophobic polymers and copolymers e.g. containing styrene, vinyl acetate, acrylonitrile, acrylic acid ester, methacrylic acid ester, N-vinylcarbazole or butadiene units, hydrophobic cellulose derivatives, phenoxy resins or polycondensates of the polyester type e.g. polycarbonates.

These polymers can be used in a mixture for improvement of the mechanical strength or adhering power of the recording layer to its support when no self-supporting layer is produced.

In order to diminish the rate of spontaneous thermal colour formation over long periods of time as might be encountered during storage of the photographic material and processing of the photographic materials so-called antifoggants may be added to the photosensitive composition. Suitable anti-foggants include triaryl compounds of group V elements e.g. triphenylstibine and sterically hindered phenols e.g. 2,6-di-tert.butyl p-cresol and other reducing or atmospheric oxygen accepting agents. Triphenylstibine and analogous compounds for the purpose of the present invention are described in the United Kingdom Pat. Specification No. 1,071,104 filed Aug. 14, 1964 by Horizons Inc.

A dry photographic coating containing the above mentioned ingredients may be formed by dissolving the binding agent(s) in a suitable inert solvent which acts as dispersing or dissolving medium for the other ingredients and which is removed from the coating composition by evaporation leaving a solid photographic recording layer on a properly chosen support. The supports may be of any kind encountered in silver halide photographic materials e.g. paper and film supports.

In order to realize the highest sensitivity, it is desirable to coat the recording layers in the absence of oxygen or to keep them before the exposure in an oxygen-free environment.

The photosensitive organic polyhalogen compounds that in exposed state form with a spiropyran compound a dyestuff salt are normally only sensitive in a wavelength range between 400 and 250 nm.

Various sensitizing agents of the enumerated classes sensitize the recording composition in its inherent sensitivity range and it is assumed that they may also be considered as chemical sensitizing agents for they may chemically interact with photoradicals formed during the exposure.

A choice of a proper combination of sensitizing agents that are active for extending the sensitivity in the visible spectrum of the print-out recording composition used in the present invention makes it possible to apply white or coloured light in the information-wise exposure.

By using organic spectral sensitizing agents e.g. that are within the scope of the definition of class (A) and that have in their structure a conjugated system of sufficient length it is possible to extent the spectral sensitivity into the visible light spectrum and even into the infrared.

The spectral sensitization over the whole visible spectrum opens the possibility to produce print-out multicolour prints by means of one and same recording material. So, on using a recording material containing superposed recording layers sensitized respectively in the red, green, and blue region of the spectrum and containing the proper dye forming combination superposed cyan, magenta and yellow part images can be produced that offer a full reproduction of the multicolour original used in the informationwise exposure.

The recording materials sensitized according to the present invention are suited to produce print-out images of different colour according to the type of spiropyran compound applied.

The stabilisation of the obtained prints may proceed by washing out the residual free radical generator with a suitable solvent or solvent mixture e.g. a hydrocarbon liquid such as petroleum ether optionally mixed with acetone, or by simply evaporating it by rising the temperature when the compound involved is sufficiently volatile. For the latter purpose and the high photosensitivity, carbon tetrabromide or a mixture of carbon tetrabromide and iodoform is preferred.

According to a preferred recording and reproduction process of the present invention the information-wise exposure is carried out in such a way that first a latent image is produced which is transformed into a visible dye image by means of a so-called "optical development".

The optical development proceeds by exposing the recording layer containing the latent or barely visible image over its entire surface with visible radiation which lies in the spectral absorption band of the products formed by the image-wise exposure and image-wise interaction of the photoexposed ingredients(1) and (2) of the mentioned photosensitive composition. In the overall exposure no exposure light is applied to which the photosensitive polyhalogen compound is inherently sensitive since thereby the effect of the image-wise exposure is masked by an overall colouration. It is advantageous to use in the optical development exposure a cut-off filter absorbing all the light corresponding with the wavelength range that is inherentely absorbed by the ingredients of the non-previously exposed recording layer.

The optical development effect is markedly speeded up and the image density increased by applying heat e.g. supplied by contact with a hot body or through infrared radiation during the overall exposure to visible light.

The increase of speed of the optical development is very outspoken by the use of the present mercapto and thione tautomers.

The optical development speed obtains a particularly high value by the use of poly-N-vinyl carbazole or the copolymers containing N-vinyl carbazole units in combination with the present mercapto compounds. The addition of a triarylstibine such as triphenylstibine to that combination intensifies the image density obtained by the optical development procedure.

It is assumed that during the exposure applied in the optical development at least a part of the overall applied light energy is visible light, absorbed by a dyestuff salt having the pyrylium structure when using a diarylo spiropyran or having an indolinium salt structure when using an indolino-arylospiropyran. Said salt seems to act as a spectral sensitizing agent for a chemical reaction between the photosensitive polyhalogen compound producing the necessary radicals for forming the dyestuff salt with the spiropyran.

In a particular preferred composition for forming print out as well as optically developable prints a mixture of $CBr_4$ and $CHJ_3$ yielding a superadditive sensitivity effect is used.

Preferred amounts of anti-fogging agent such as triphenyl stibine are with respect to photosensitive carbon tetrabromide and/or iodoform within the weight ratio range of 1:100 to 2.5:100.

According to an alternative embodiment of the optical development technique the recording material is first overall exposed to electromagnetic radiation to produce non-differentially over the whole recording layer latent dyestuff centres that are afterwards optically developed information-wise by a sufficiently strong information-wise exposure in the absorption band of the dyestuff centres. Optionally the information-wise exposure proceeds simultaneously with an overall heating e.g. effected by an overall infra-red light exposure.

Instead of applying an overall pre-exposure to form the dyestuff centres these dyestuffs may be added e.g. applied by imbibition (diffusion) in minor amounts to the recording layer composition to act as optical development nuclei for the dye image formation by image-wise exposure.

According to a special embodiment the spiropyrans are formed in the non-exposed recording layer composition "in situ" by starting from the corresponding pyrylium and indolinium salts and adapting the pH in a proper way to obtain the spiropyrans that may be considered as the dyestuff precursors of the pyrylium and indolinium salts, respectively.

The information-wise exposure applied in the present invention may be a contact exposure of the direct or reflex type and also an optical projection exposure as used e.g. in an optical enlarging apparatus. The informationwise exposure need not be simultaneous in all parts of the recording material. The exposure may be progressive in one continuous step as e.g. in sound track recording or in successive intermittent steps provided that the required information-wise change is obtained. Thus the recording material may be scanned with an image-wise modulated radiant energy spot of high intensity e.g. a laser beam, or the material may be progressively exposed through a slit, e.g. is exposed to copying light of a tubular lamp that is given a translation movement along the original.

A recording material of the present invention being suited for the recording of information in the form of modulated ultraviolet radiation can be used in X-ray and electron-beam recording. X-ray beams can be absorbed in high energy absorbing substances and create by means of them so-called secundary photons e.g. of the ultraviolet radiation energy band and photo-electrons that are absorbed by the photosensitive polyhalogen compound forming through its photoradicals a dyestuff salt with the spiropyran. Substances for high energy absorption that may be incorporated in the recording element contain the elements lead, mercury, bismuth, barium and/or tungsten. Lead compounds that themselves are photosensitive are preferred e.g. lead monoxide, lead bromide and lead iodide.

Suitable light sources for use in a recording method of the present invention are ultra-violet light sources, xenon-gas lamps, incandescent bulbs, the light of the sun and flash lamps. In the overall exposure for the optical development an infra-red lamp emitting also in the visible spectrum is preferably used.

Electron beam and laser beam recording proceed with the apparatus suited for that purpose and known to those skilled in the art.

Recording materials of the present invention are very versatile in that they by the use of a proper sensitizing agent can be applied for continuous tone or halftone reproduction. They can offer very contrasty images so that they are very suited for the reproduction of line and screen type originals and find a successful use in a great variety of graphic art applications. Due to the very high resolving power of the recording materials (the dyestuffs are formed in molecularly divided form) the recording materials of the present invention are particularly suited for microfilm reproduction and high precision image rendering as e.g. in the production of optical micromask masters used in the manufacturing of microelectronic circuitry.

The reflex-exposure properties of the present recording materials make them very useful in the document reproduction sector since they offer in a reflex-contact exposure print-out images of a sufficiently intense spectral density.

According to a special application a recording layer as described herein is used in conjunction with a magnetic recording layer and is more particularly applied at the rear side of a flexible tape support carrying the magnetic recording layer. Using such a material a sound track is formed in the magnetic recording layer and a visual text image corresponding with the sound track photographed on the recording layer of the present invention.

Such a recording material thus allows the storings of optical and acoustic signals and makes it possible to reproduce both informations simultaneously.

The present invention is illustrated by the following examples without, however, limiting it thereto. The percentages are by weight unless otherwise indicated.

EXAMPLE 1

A photosensitive recording layer was prepared by coating 200 mg of carbon tetrabromide, 200 mg of iodoform, 25 mg of di-β-naphthospiropyran and 10 mg of 2-mercaptobenzthiazole dissolved in 10 ml of a 5 % solution of polystyrene in methylene chloride at a thickness of 0.1 mm onto an unsubbed polyethylene terephthalate support.

After drying in the dark at 50°C the recording layer was exposed for 2 min. through a grey wedge (constant 0.15) with a 80 W high pressure mercury vapour lamp type HPL sold by N. V. Philips' Gloeilampenfabrieken - Eindhoven (The Netherlands) placed at a distance of 10 cm. The exposure resulted in the print-out reproduction of 12 steps.

The same recording material was used for optical development proceeding as follows.

1. the recording layer was first image-wise exposed under the same conditions as described for the print-out exposure, the image-wise exposure lasting, however, only 0.5 sec. and resulting in a latent image;
2. subsequently the latent image was optically developed to a cyan visible image having a maximum density 1.5 by means of an overall exposure lasting 30 sec. and carried out with a 250 W infrared lamp emitting also in the visible spectrum (the lamp is sold by Bie and Berntsen, 35 Pilestraede, Copenhagen, Danmark). During the overall exposure a cut-off filter (Corning C.S. 3-67) was used absorbing all the light having a wavelength smaller than 540 nm.

The image was stabilized by heating the recording material for 1 min. at 150°C.

EXAMPLE 2

A photosensitive composition consisting of 500 mg of carbon tetrabromide, 20 mg of di-β-naphthospiropyran, 40mg of 2-mercapto-benzthiazole and 10 ml of a 5 % by weight solution of polystyrene in methylene chloride was coated at a thickness of 0.10 mm onto a non-subbed polyethylene terephthalate support. The coated layer was dried at 50°C.

The obtained photosensitive recording layer was contact-exposed through a transparent line original. The image-wise exposure lasted 1 sec. and was carried out with a 80 W high pressure mercury vapour bulb, type HPL (trade name) placed at a distance of 10 cm with respect to the recording layer. A latent (non-visible) image was obtained.

This latent image was developed optically by means of an overall exposure of 90 sec through a cut-off filter absorbing all the light having a wavelength smaller than 540 nm and using a 250 W infra-red lamp placed at a distance of 15 cm. A visible image with a density more than 2.5 (measured in transmission) was obtained.

The fixation of the obtained visible image proceeded by heating the recording material at 150°C for 1 min.

In the absence of 2-mercapto-benzthiazole the imagewise exposure lasted 60 sec for obtaining a same result in the optical development.

Said recording material yielded by a contact exposure of 2 min effected through a grey step-wedge (constant : 0.15) with the same ultra-violet lamp a wedge print containing 8 visible steps.

EXAMPLE 3

A photosensitive composition consisting of 0.10 g of carbon tetrabromide, 0.10 g of iodoform, 0.10 g of 3-methyl-di-β-naphthospiropyran, 0.02 g of triphenylstibine, 0.010 g of mercapto- or thione-compound listed in the following table and 8 ml of a 5 % solution of poly-N-vinylcarbazole in a mixture of methylene chloride and 1,1,2-trichloroethane (1:1 by volume) were coated separately at a thickness of 0.10 mm onto a non-subbed polyethylene terephthalate support. The coatings were dried at room temperature for 24 h. The obtained recording materials were contact-exposed through a grey wedge (constant: 0.15) using a CHEMCO-exposure apparatus MODEL D-7, Double Sided Photoprinter of Chemcut Corp. and containing 9 ultraviolet fluorescent lamps of each 20 W covering an exposure area of 60 × 60 cm. The exposure times were long enough to obtain a latent image.

The exposed film strips were optically developed by an overall exposure with a 250 W infra-red lamp placed at a distance of 15 cm and irradiating the recording material through a cut-off filter (Corning filter CS 3-67) absorbing all the light emitted below 540 nm.

The same recording materials were used for the production of print-out images and for that purpose exposed in contact through a grey wedge (constant : 0.15) applied in an ACTINA SH (trade name) diazo copying apparatus operating with an ultra-violet light source of 1000 W. The exposure time was long enough to obtain a maximum optical density of at least 2.

The obtained images were stabilized by heating the recording layers at 180°C.

In the following table data of the print-out and optical development processing are listed.

Table

| Structural formula of sensitizing agent | Number of wedge steps reproduced in print-out | Optical development processing: Duration of the image-wise exposure (sec) | Optical development processing: Duration of the overall exposure (sec) |
|---|---|---|---|
| — | 8–9 | 8 | 120 |
| 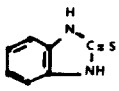 | 12 | 0.5 | 3 |
| 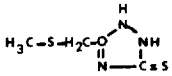 | 11 | 5 | 60 |
| 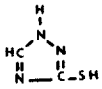 | 10 | 7 | 60 |
| 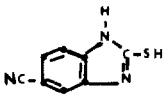 | 11 | 3 | 30 |

EXAMPLE 4

A photosensitive composition consisting of 0.12 g of carbon tetrabromide, 0.12 g of iodoform, 0.15 g of 3-methyl-di-β-naphthospiropyran, 0.02 g of triphenylstibine, 0.015 g of 2-mercaptobenzthiazole and 10 ml of a 5 % solution of poly-N-vinylcarbazole in a mixture of methylene chloride and 1,1,2-trichloroethane (1:1 by volume) was coated at a thickness of 0.12 mm onto a non-subbed polyethylene terephthalate support. The coating was dried for 1 h at 50°C. The obtained recording material was contact-exposed for 5 min. through a grey wedge (constant : 0.15) using a CHEMCUT-exposure apparatus MODEL D-7, Double Sided Photoprinter containing 9 ultra-violet fluorescent lamps of each 20 W covering an exposure area of 60 × 60 cm.

The exposed film strip was divided up longitudinally into two parts. Of one of them immediately the maximum spectral density of the wedge step prints was measured by transmission under small intensity red light conditions. The other part was stabilized thermally by heating it for 15 sec. at 180°C (strong ventilation). Subsequently the spectral density of the wedge print steps was measured by transmission. The comparison of the obtained spectral density results gives an idea of the image density increase during the thermal stabilisation.

The results of these measurements is listed in the following table.

Table

| Number of the step | Spectral density after exposure and before thermal stabilisation | Spectral density after exposure and thermal stabilisation |
|---|---|---|
| 1 | 0.72 | 2.60 |
| 2 | 0.60 | 2.55 |
| 3 | 0.50 | 2.27 |
| 4 | 0.38 | 2.20 |
| 5 | 0.33 | 2.05 |
| 6 | 0.27 | 1.73 |
| 7 | 0.20 | 1.20 |
| 8 | 0.16 | 0.67 |
| 9 | 0.14 | 0.40 |
| 10 | 0.10 | 0.20 |
| 11 | — | 0.12 |
| 12 | — | 0.08 |

EXAMPLE 5

A photosensitive composition consisting of 0.12 g of carbon tetrabromide, 0.12 g of iodoform, 0.15 g of 3-methyl-di-β-naphthospiropyran, 0.04 g of triphenylstibine, 0.01 g of 2-mercaptobenzthiazole and 10 ml of a 5 % poly-N-vinyl carbazole solution in a mixture of methylene chloride and 1,1,2-trichloroethane (1:1 by volume) was coated at a thickness of 0.12 mm onto a non-subbed polyethylene terephthalate support. The coating was dried for 1 h at 60°C.

The obtained photosensitive film was reflectographically exposed in contact with an opaque original being a black printed text on a white paper. The exposure was carried out in the 3M PHOTOCOPIER 179 (trade name) operating at full intensity for an exposure time of 4 sec.

Subsequently the recording material was optically developed by overall exposing it for 3 to 5 sec. with an infrared lamp of 250 W (sold by Bie and Berntsen, 35 Pilestraede, Copenhagen, Danmark) placed at 15 cm and emitting also in the visible part of the spectrum.

Between the infra-red lamp and the recording layer a cut-off filter was placed absorbing all the light with a wavelength smaller than 540 nm (Corning C.S. 3-67).

A very sharply defined blue-black negative image of the original was obtained having in the image parts a maximum optical density of 2.5 and in the image-back ground parts an optical density of less than 0.01.

The image was stabilized by a 15 sec heat treatment at 180°C in a ventilated drying box. .

EXAMPLE 6

A photosensitive composition consisting of 100 mg of carbon tetrabromide, 100 mg of iodoform, 120 mg of 3-methyl-di-β-naphthospiropyran, 10 mg of 2-mercaptobenzthiazole, 20 mg of triphenylstibine and 10 ml of a 5 % solution of poly-N-vinylcarbazole in a mixture of methylene chloride/1,1,2-trichloroethane (1:1 volume ratio) was coated at a thickness of 0.1 mm onto a polyethylene terephthalate film strip provided with a conductive subbing layer of CALGON CONDUCTIVE POLYMER 261 (registered trade-mark of Calgon Corporation, Inc., Pittsburgh, Pa., U.S.A. for a solution containing 39.1 % by weight of conductive polymer having recurring units of the following type:

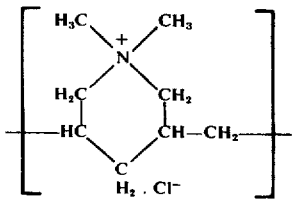

The obtained photosensitive recording layer was dried at 50°C.

The electron-beam sensitivity of the photosensitive layer was tested in a vacuum of $10^{-4}$ mm Hg.

The electron beam recording proceeded with electrons accelerated by a potential difference of 20 kV. The charge density measured at the level of the recording layer was $2.10^{-5}$ coulomb per sq. cm.

The optical density (measured in transmittance) of the area struck by the electron beam was 2. The measurement ws preceded by a 10 sec thermal stabilization at 175°C.

EXAMPLE 7

A photosensitive recording layer was prepared by coating 200 mg of carbon tetrabromide, 200 mg of iodoform, 50 mg of di-β-naphthospiropyran and 10 mg of 1-methyl-2-mercaptobenzthiazole and 8 ml of a 5 % solution of poly-N-vinylcarbazole in a mixture of methylene chloride/benzene (50:50 volume ratio) at a thickness of 0.1 mm onto an unsubbed polyethylene terephthalate support.

The coated layer was dried at 60°C.

The recording layer was exposed for 2 min. through a grey wedge (constant 0.15) with a 80 W - HPL (trade name) ultraviolet lamp placed at a distance of 10 cm. The exposure resulted in a print-out wedge image containing 15 visible steps.

The image stabilisation was effected by heating at 180°C.

The same recording layer was used for optical development proceeding as follows:

1. the recording layer was first image-wise exposed for 1 sec. in contact with a transparent line original. In the image-wise exposure the same ultra-violet lamp and exposure distance was used as in the print-out exposure.

The obtained latent image was optically developed by means of an overall exposure lasting 5 sec using an infrared red lamp of 250 W associated with a cut-off filter absorbing all the light having a wavelength smaller than 580 nm (Corning CS 3-13). A negative cyan image with optical density >1 was obtained that was stabilised by heating the recording layer at 180°C.

EXAMPLE 8

Photosensitive compositions consisting of an intimate mixture of 500 mg of carbontetrabromide, 10 mg of di-β-naphthospiropyran (compound 1 of Table 1) and 5 mg of one of the sensitizing thio-compounds indicated by number in the description and 8 ml of a 5 % solution of polystyrene in methylene chloride were coated separately at a thickness of 0.1 mm onto non-subbed polyethylene terephthalate film strips. The thus obtained recording layers containing each a different sensitizing agent were dried during 30 min. at 50°C in the dark.

The obtained samples were tested on print-out and optical development sensitivity as explained in Example 7. The results of these tests are listed in the following table.

Table

| Number of the Sensitizing agent | Number of the by print-out reproduced wedge steps | Optical development Duration of the image-wise exposure (sec.) | Duration of the overall exposure for D=1 (min.) |
|---|---|---|---|
| — | 3 | 120 | D too weak |
| 1 | 5 | 2 | 2 |
| 3 | 4–5 | 3 | 1.5 |

EXAMPLE 9

A photosensitive composition of 250 mg of carbon tetrabromide, 200 mg of iodoform, 30 mg of di-β-naphthospiropyran (compound 1 of Table 1) and 5 mg of the sensitizing mercapto compound No. 1 were dissolved in a 5 % solution of polystyrene in methylene chloride. The composition was coated separately at a thickness of 0.1 mm onto a non-subbed polyethylene terephthalate film strip.

The obtained photosensitive recording layer was dried, and tested on its print-out and optical development sensitivity as described in Example 7.

| Number of the by print-out reproduced wedge steps | Optical development | |
|---|---|---|
| | Duration of the image-wise exposure (sec.) | Duration of the overall exposure for D=1 (sec.) |
| 12 | 0.8 | 20–30 |

We claim:

1. A photographic process for forming a visible image in a recording material which comprises in intimate admixture:

1. at least one spiropyran compound of the group consisting of a spirodibenzopyran, a spirodinaphthopyran, a spirobenzonaphthopyran, a 1,3,3-trimethylindolino-benzospiropyran, a 1,3,3-trimethylindolinonaphthospiropyran, or a spiropyran that contains a condensed anthracene or phenanthrene nucleus;
2. at least one ultra-violet light-sensitive organic polyhalogen compound capable of producing on exposure with ultra-violet light a dye salt with the spiropyran compound and having the general formula:

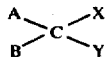

wherein:

each of A, B, X and Y is a chlorine, bromine or iodine atom; or one of said radicals A, B, X or Y is an alkyl group, an aryl group, or an aroyl group and the other radicals are each chlorine, bromine or iodine; or two of said radicals A, B, X or Y each is an aromatic acyl group and the other radicals are each chlorine, bromine or iodine; and 3. in working relationship with said mixture a tautomeric organic nitrogen containing compound corresponding to the following general formula:

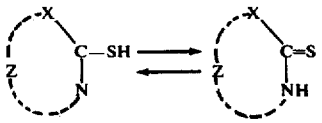

in which:

X represents oxygen, sulphur, selenium or the group -NR in which R is hydrogen, or an alkyl, allyl, or phenyl group, and Z represents the necessary atoms to close a 5- or 6-membered heterocyclic nitrogen-containing ring system, said process comprising the steps of exposing said recording material to activating ultraviolet radiation of an intensity sufficient to produce a visible image directly or a latent image that can be rendered visible by optical development.

2. The process of claim 1 wherein said exposure produces a latent image and said latent image is optically developed and comprising the steps of: imagewise exposing the recording material to activating ultraviolet radiation of an intensity sufficient to bring about a latent or barely visible image having an increased spectral sensitivity in a wavelength range outside the inherent sensitivity range of the ultra-violet light-sensitive compound, and then uniformly exposing the entire imagewise exposed recording material to light within the wavelength range for which the initially exposed portions are of increased sensitivity than the initially non-exposed portions, thereby increasing the visibility of said initially formed image.

3. The process of claim 1 wherein said exposure produces a latent image and said latent image is optically developed and comprising the steps of: uniformly exposing the entire recording material to ultraviolet radiation of an intensity sufficient to bring about in the recording material an increase in its spectral sensitivity in a wavelength range outside the inherent sensitivity range of the ultra-violet light-sensitive compound, and then image-wise exposing the overall exposed recording material within the wavelength range for which the overall exposed recording material is of increased sensitivity to increase the visibility of the initially formed image.

4. A photographic process according to claim 1 wherein the recording material after the formation of a visible image is overall heated to bring about image stabilization.

5. A photographic process according to claim 1 wherein said spiropyran compound corresponds to one of the following general formulae:

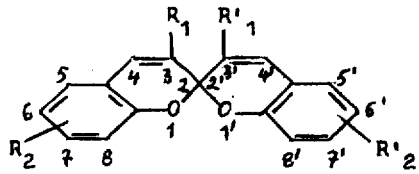

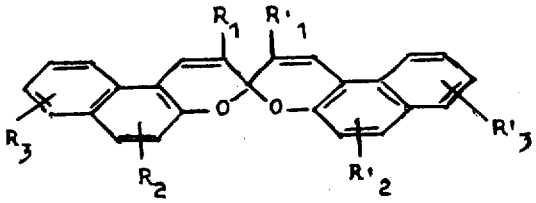

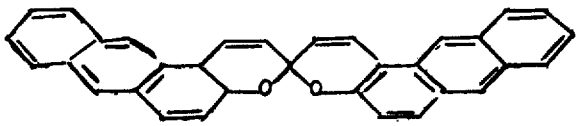

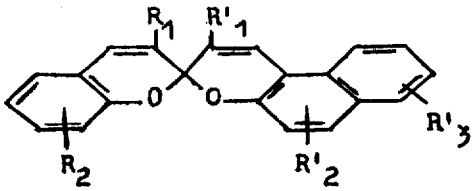

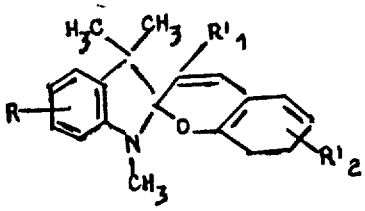

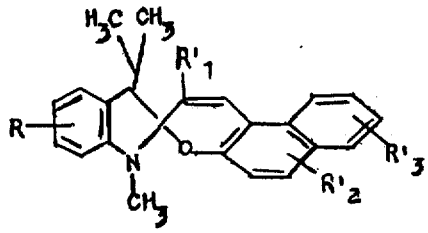

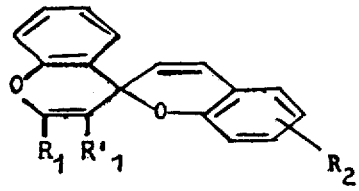

wherein:

R, $R_1$, $R'_1$, $R_2$, $R'_2$, $R_3$ and $R'_3$ each represent hydrogen, alkyl, alkyl substituted with halogen, alkyl substituted with an ester group, alkyl substituted with a carboxyl group, alkyl substituted with a N-phenylcarbamyl group, a hydroxy group, an alkoxy group, an aryloxy group, a phenyl group, piperidyl, acetyl, halogen, nitro, or $R_1$ and $R'_1$ together represent a $-(CH_2)_n-$chain wherein $n = 2$ or 3 to link the carbon atoms in the 3 and 3′ positions together.

6. A process according to claim 1 wherein said ultraviolet light-sensitive compound is carbon tetrabromide or iodoform.

7. A process according to claim 1 wherein said ultraviolet light-sensitive compound is a mixture of carbon tetrabromide and iodoform is used.

8. A process according to claim 1 wherein said mixture is used in association with at least one sensitizing compound of the following classes:

A. an organic compound containing two radicals of different electron-affinity linked to each other through a conjugated system, and having one of the following general formulae (I), (II), (III), (IV), (V) or (VI):

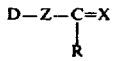

(I)

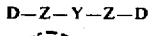

(II)

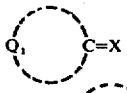

(III)

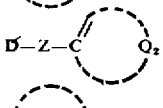

(IV)

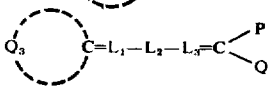

(V)

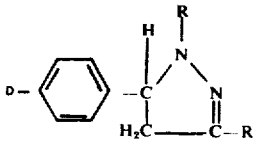

(VI)

wherein:

D represents an electron-donating group selected from an amino group substituted with alkyl, cycloalkyl or aralkyl, a hydroxy group or a hydroxy group substituted with alkyl, cycloalkyl or aralkyl, Z represents a polymethine chain, an azamethine chain, phenylene or naphthalene, R represents hydrogen, an alkyl group, an aryl group or the necessary atoms to form a homocyclic or heterocyclic ring with an atom of the group Z, $Q_1$ represents the non-metal atoms necessary to complete a ring or ring system in which the group C=X is linked through a conjugated system of methine groups or of a chain of methine groups bound to nitrogen to a group D, X represents an electronegative atom or group being selected from the group consisting or oxygen, =N—R wherein R is hydrogen or an aromatic group, sulphur, selenium, or

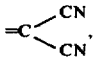

$Q_2$ represents the necessary atoms to form with the carbon atom of the group

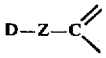

a heterocyclic ring having an electronegative character with respect to the group D, Y represents an electron-attracting group selected from the group consisting of

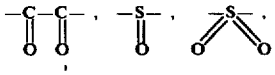

or the group

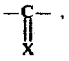

wherein X has the above meaning, $Q_3$ represents a heterocyclic nucleus, containing an alkylamino group, P and Q each represent an electron-attracting cyano group, or P and Q together represent the necessary atoms to close a heterocyclic ring with electronegative character, each of $L_1$ and $L_3$represent a methine group, and $L_2$ represents a monovalent chemical bond, a

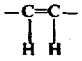

group or a plurality of such group linked to each other, or $L_1$, $L_2$ and $L_3$ represent together a double bond linking the group

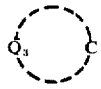

to the group

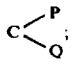

B. organic compounds containing an aromatic ring having two adjacent carbon atoms thereof in common with an adjacent ring free of conjugation, said adjacent ring at one end being linked to said aromatic ring through a carbon-carbon bond and at the other end is linked to said ring through an electron-donating group and having one of the following structural formulae:

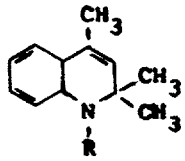

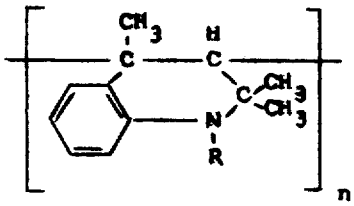

wherein:

*n* is a positive integer of at least 2, and

R is hydrogen or an alkyl group;

C. polymeric compounds containing recurring units corresponding to the following general structure:

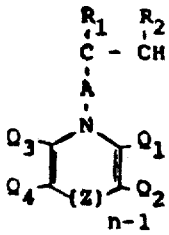

wherein:

Z is a sulphur atom or a single bond,

A is a single bond or a divalent hydrocarbon group, $R_1$ is hydrogen or a lower alkyl group, $R_2$ is hydrogen or a lower alkyl group, $Q_1$ and $Q_2$ each represent a hydrogen atom or together the necessary atoms to close an adjacent carbocyclic ring, $Q_4$ and $Q_3$ each represent a hydrogen atom or together the necessary atoms to close an adjacent carbocylic ring, and

*n* is 1 or 2; and

D. an inorganic photoconductive metal compound in which said metal is zinc or lead.

9. A process according to claim 1 wherein said recording material contains as an anti-fogging agent a triaryl compound of a group V element or a sterically hindered phenol.

10. A process according to claim 1 wherein the mixture is present in a layer of at least one polymeric binding agent of the group of styrene, vinyl acetate, acrylonitrile, acrylic acid ester, methacrylic acid ester, N-vinylcarbazole or butadiene units, a hydrophobic cellulose derivative, a phenoxy resin or polyester polycondensate.

11. A process according to claim 1 wherein the exposure is a direct exposure.

12. A process according to claim 1 wherein the exposure is a reflex exposure.

13. A process according to claim 1 wherein the exposure is an electron beam exposure.

14. A photosensitive recording material for the direct production of a visible image by imagewise exposure to activating ultraviolet radiation which comprises a layer of an intimate mixture consisting essentially of:

1. at least one spiropyran compound of the group consisting of a spirodibenzopyran, a spirodinaphthopyran, a spirobenzonaphthopyran, a 1,3,3-trimethylindolino-benzospiropyran, a 1,3,3-trimethylindolinonaphthospiropyran, or a spiropyran that contains a condensed anthracene or phenanthrene nucleus;
2. at least one ultra-violet light-sensitive organic polyhalogen compound capable of producing on exposure with ultra-violet light a dye salt with the spiropyran compound and having the general formula:

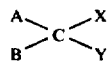

wherein:

each of A, B, X and Y is a chlorine, bromine or iodine atom; or one of said radicals A, B, X or Y is an alkyl group, an aryl group, or an aroyl group and the other radicals are each chlorine, bromine or iodine; or two of said radicals A, B, X or Y each is an aromatic acyl group and the other radicals are each chlorine, bromine or iodine; and 3. in working relationship with said mixture a tautomeric organic nitrogen containing compound corresponding to the following general formula:

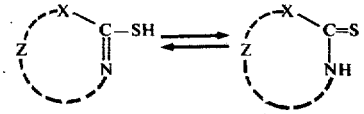

in which:

X represents oxygen, sulphur, selenium or the group

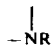

in which R is hydrogen or an alkyl, allyl, or phenyl group, and

Z represents the necessary atoms to close a 5- or 6-membered heterocyclic nitrogen-containing ring system.

15. A photographic material according to claim 14 wherein said spiropyran compound corresponds to one of the following general formulae:

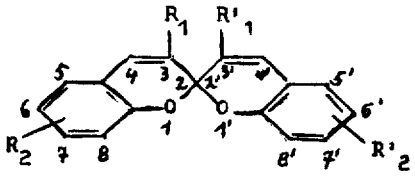

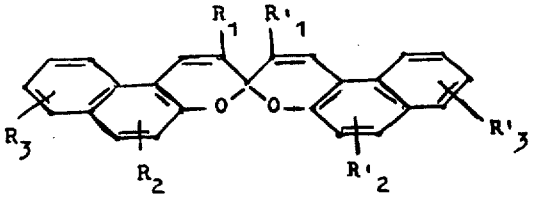

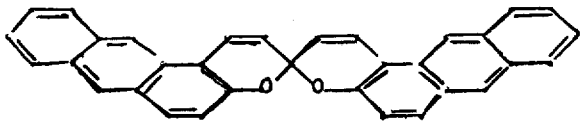

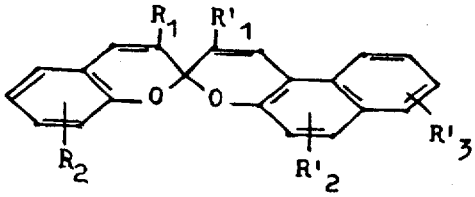

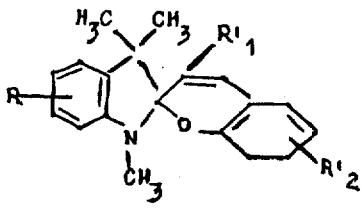

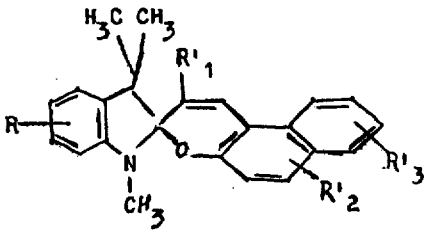

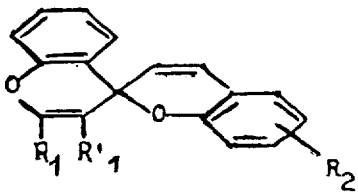

wherein:

R, $R_1$, $R'_1$, $R_2$, $R'_2$, $R_3$ and $R'_3$ each represent hydrogen, alkyl, alkyl substituted with halogen, alkyl substituted with an ester group, alkyl substituted with a carboxyl group, alkyl substituted with a N-phenylcarbamyl group, a hydroxy group, an alkoxy group, an aryloxy group, a phenyl group, piperidyl, acetyl, halogen, nitro, or $R_1$ and $R'_1$ together represent a $-(CH_2)_n-$chain wherein n = 2 or 3 to link the carbon atoms in the 3 and 3′ positions together.

16. A material according to claim 14 wherein said ultraviolet light-sensitive compound is carbon tetrabromide or iodoform.

17. A material according to claim 14 wherein said ultraviolet light-sensitive compound is a mixture of carbon tetrabromide and iodoform is used.

18. A material according to claim 14 wherein said mixture is used in association with at least one sensitizing compound of the following classes:

A. an organic compound containing two radicals of different electron-affinity linked to each other through a conjugated system, and having one of the following general formulae (I), (II), (III), (IV), (V) or (VI):

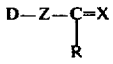

(I)

(II)

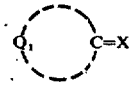

(III)

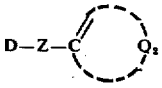

(IV)

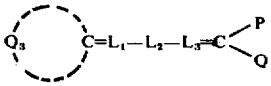

(V)

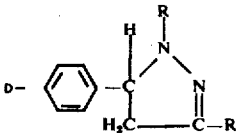

(VI)

wherein:

D represents an electron-donating group selected from an amino group substituted with alkyl, cycloalkyl or aralkyl, a hydroxy group or a hydroxy group substituted with alkyl, cycloalkyl or aralkyl, Z represents a polymethine chain, an azamethine chain, phenylene or naphthalene, R represents hydrogen, an alkyl group, an aryl group or the necessary atoms to form a homocyclic or heterocyclic ring with an atom of the group Z, $Q_1$ represents the non-metal atoms necessary to complete a ring or ring system in which the group C=X is linked through a conjugated system of methine groups or of a chain of methine groups bound to nitrogen to a group D, X represents an electronegative atom or group being selected from the group consisting of oxygen, =N-R wherein R is hydrogen or an aromatic group, sulphur, selenium, or

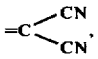

$Q_2$ represents the necessary atoms to form with the carbon atom of the group

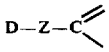

a heterocyclic ring having an electronegative character with respect to the group D, Y represents an electron-attracting group selected from the group consisting of

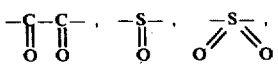

or the group

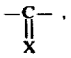

wherein X has the above meaning, $Q_3$ represents a heterocyclic nucleus, containing an alkylamino group, P and Q each represent an electron-attracting cyano group, or P and Q together represent the necessary atoms to close a heterocyclic ring with electronegative character, each of $L_1$ and $L_3$ represent a methine group, and $L_2$ represents a monovalent chemical bond, a

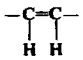

group or a plurality of such group linked to each other, or $L_1$, $L_2$ and $L_3$ represent together a double bond linking the group

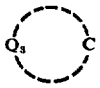

to the group

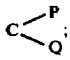

B. organic compounds containing an aromatic ring having two adjacent carbon atoms thereof in common with an adjacent ring free of conjugation, said adjacent ring at one end being linked to said aromatic ring through a carbon-carbon bond and at the other end is linked to said ring through an electron-donating group and having one of the following structural formulae;

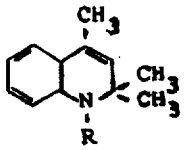

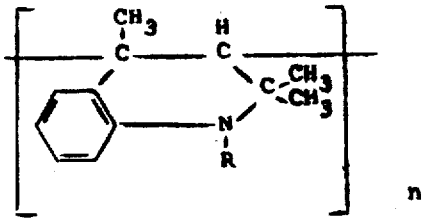

wherein:

*n* is a positive integer of at least 2, and

R is hydrogen or an alkyl group;

C. polymeric compounds containing recurring units corresponding to the following general structure:

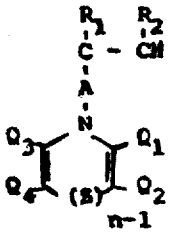

wherein:

Z is a sulphur atom or a single bond,

A is a single bond or a divalent hydrocarbon group, $R_1$ is hydrogen or a lower alkyl group, $R_2$ is hydrogen or a lower alkyl group, $Q_1$ and $Q_2$ each represent a hydrogen atom or together the necessary atoms to close an adjacent carbocyclic ring, $Q_4$ and $Q_3$ each represent a hydrogen atom or together the necessary atoms to close an adjacent carbocyclic ring, and

*n* is 1 or 2; and

D. an inorganic photoconductive metal compound in which said metal is zinc or lead.

19. A photosensitive recording material according to claim 14, containing as an anti-fogging agent a triaryl compound of a group V element and a sterically hindered phenol.

20. A photosensitive recording material according to claim 14, wherein the recording material contains said spiropyran compound in admixture with said photosensitive organic polyhalogen compound in a ratio by weight of 1:1-50.

21. A photosensitive recording material according to claim 18 wherein the recording material contains said spiropyran compound and poly-N-vinylcarbazole in a ratio by weight within the range of 80:100 to 10:100.

22. A photosensitive recording material according to claim 21 wherein the recording material contains photosensitive carbon tetrabromide or iodoform or a mixture thereof in a ratio with respect to said poly-N-vinylcarbazole in the range of 160:100 to 20:100 by weight.

23. A photosensitive recording material according to claim 22 wherein the recording material contains triphenyl stilbine with respect to said photosensitive polyhalogen compound in a ratio by weight in the range of 1:100 to 2.5:100.

* * * * *